US005410924A

United States Patent [19]

Krasnov

[11] Patent Number: 5,410,924

[45] Date of Patent: May 2, 1995

[54] SHEAR GRIPPING APPARATUS AND METHOD

[76] Inventor: Igor Krasnov, 6835 Oakwood Trace Ct., Houston, Tex. 77040

[21] Appl. No.: 174,986

[22] Filed: Dec. 29, 1993

Related U.S. Application Data

[63] Continuation-in-part of Ser. No. 893,400, Jun. 4, 1992, abandoned.

[51] Int. Cl.[6] ..... B25B 13/50

[52] U.S. Cl. ..... 81/57.33; 81/57.32; 81/74; 29/426.5

[58] Field of Search ..... 81/57.29, 57.32, 57.33, 81/57.39, 57.46, 74, 487; 29/401.1, 402.01, 426.5

[56] References Cited

U.S. PATENT DOCUMENTS

| | | | |
|---|---|---|---|
| 4,489,929 | 12/1984 | Blechschmidt | 269/282 |
| 4,527,466 | 7/1985 | Kossor et al. | 296/152 |
| 4,554,720 | 11/1985 | Garman | 81/57.39 |
| 4,836,064 | 6/1989 | Slator | 81/57.18 |
| 4,869,137 | 9/1989 | Slator | 81/57.18 |

*Primary Examiner*—James G. Smith
*Attorney, Agent, or Firm*—Joseph R. Dwyer

[57] ABSTRACT

A torque transfer apparatus and method wherein a device such as a pipe tong is provided with hard metallic inserts (steel) on the tong jaws with thin facing material (bonding key material) which is interposed between the surface of the pipe and the insert. This soft bonding key material, aluminum or bronze sheeting, or coatings of soft alloy, under pressure by the clamping force of the tong jaws flows into the imperfections in the pipe and the imperfections in the insert thereby creating a bond. The bond fails when the applied torque overcomes the shear strength of the key material, shearing off small protrusions from the surface of the key material. This leaves the pipe surface undamaged. The surface of the inserts are provided with grooves and drainage holes and to insure greater contact with the pipe whose diameter may vary, the inserts are made from spring steel with a smaller diameter than that of the pipe so that when the clamping force is applied, the insert and the bonding key material straighten out and wrap around the pipe.

18 Claims, 6 Drawing Sheets

SHEAR GRIPPING APPARATUS AND METHOD

This is a continuation-in-part of application Ser. No. 07/893,400 filed Jun. 4, 1992, abandoned.

BACKGROUND OF THE INVENTION

This invention relates, in general, to friction devices, such as brakes, clutches and friction drives where a high coefficient of friction with high contact load is critical.

This invention is particularly directed to a method and apparatus for transferring torque to drill pipe or casing, such as by manual or power tongs or other gripping assemblies, used on the rig floor of an oil and gas drilling or production rig either onshore or offshore.

More specifically, this invention is an improvement in the grippers on the jaws of such torque transfer apparatus and an improvement in the method of transferring torque to drill pipe or casing.

In known friction devices, the coefficient of sliding friction K is determined by the pairs of materials used and it is common to use hardened sharp steel teeth on the faces of the grippers against the softer pipe material so that the teeth are forcibly clamped around the pipe. The greater the clamping force, the better the grip on the pipe to avoid slippage, By penetrating and damaging pipe surfaces, these teeth developed a K equal to 0.5 to 1 or greater. Unfortunately, metal is chiseled out of the pipe if slippage occurs. The penetration of the pipe by the teeth and the slippage, if the latter occurs, sacrifice tool joints and the body of the pipe.

Another tendency in the prior art is to make the grippers out of a material that will provide minimum wear to the grippers if slippage occurs between the grippers and the pipe. Knowing the limitations of the coefficient of friction, prior art developed in the direction of increased contact area and evenly distributed normal loads, such as in the U.S. Pat. Nos. 4,836,064 and 4,869,137 by D. T. Slator. In the devices described by these patents, rubber backing is used to more evenly distribute normal loads on the pipe. In this way, with relatively low coefficient of friction, greater normal load can be applied with a reduced negative effect on the pipe.

Other gripping arrangements used to achieve the same effect comprises steel needles flexibly bonded together by rubber so that, under normal load, the shifting of the needles redistributes contact pressure.

It is also recognized that in the prior art, a pair of different materials with high coefficient friction is used, for example, composite brake pads against a steel disk. Both the pads and the disks wear out although the pads wear the most and are considered replaceable.

It is also known from friction physics that a majority of materials have a higher dry coefficient of friction against themselves than against other materials. Materials of the same origin have a tendency under load to form a bond similar to a cold weld and when there is slippage between the materials, galling occurs where small particles of the material are removed from the surfaces and jammed between the moving parts and in the prior art, there have been a full range of measures used to prevent galling from happening.

This invention, on the other hand, can be said to be an alternative to the prior art of friction gripping, ie, hard gripping surfaces against soft pipe surfaces and goes in the opposite direction to the prior art developments by providing a material softer than the pipe which contacts the pipe and wherein bonding becomes a desirable feature. In this invention, the transfer of rotational torque to the pipe then becomes a function of the shear strength of the softer material and, if slippage occurs, the softer material is damaged rather than the pipe.

SUMMARY OF THE INVENTION

According to this invention, to transfer torque to a pipe from a device, such as a pipe tong, hard steel inserts on the tong jaws are provided with a soft thin facing material (bonding key material) to form insert assemblies which interpose the bonding facing or key material between the pipe surface and the inserts. The bonding key material, such as a coating of aluminum or bronze soft alloy, or aluminum or bronze sheeting, under pressure flows into the imperfections in the drill pipe and imperfections in the insert thus creating a bond. The bond fails when the applied torque overcomes the shear strength of the facing or key material, shearing off small protrusions from the surface of the key or face material into the pipe. This leaves the pipe surface undamaged and the key material galled on the surface.

The transfer of torque to the pipe surface provides a shear gripping drag which is proportional to the shear strength of the key material and its capability to flow into microscopic imperfections. The surface of the inserts are provided with grooves and drain holes and to insure a greater contact with the pipe whose diameter may vary slightly, the insert is made from spring steel and its diameter is smaller than that of the pipe so that, when a clamping force is applied, the insert assemblies straighten out wrapping around the pipe.

As will be apparent to those skilled in the art, utilizing a key material, the shear gripping drag is proportional to the contact surface with the same clamping force and that the pipe surface can be coated with the same key material to more effectively increase the bonding effect of the key material.

DETAILED DESCRIPTION

Figure 1:
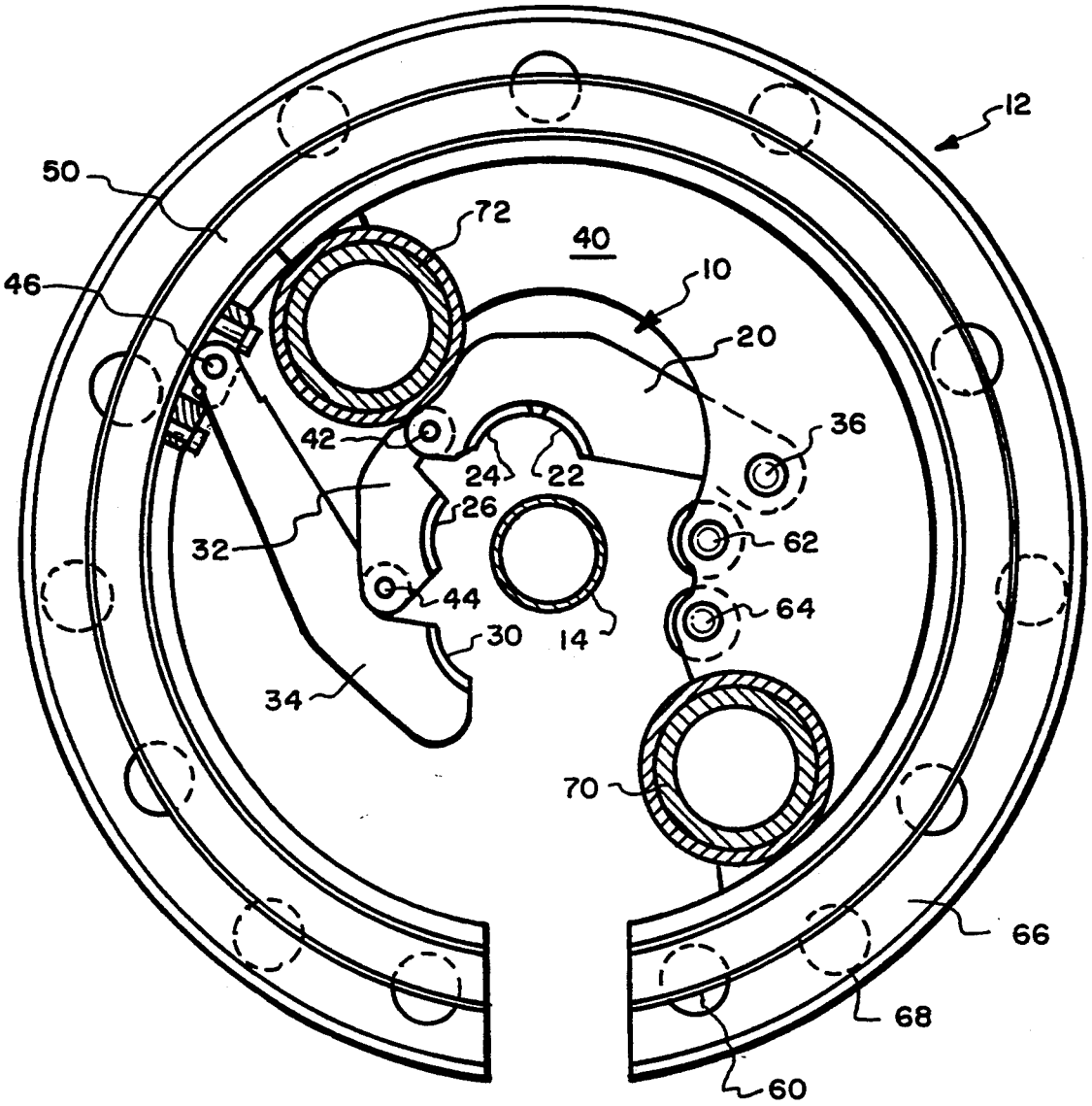
FIG. 1 is a plan view of a gripping assembly for gripping a pipe with its jaws shown in open position.
Figure 2:
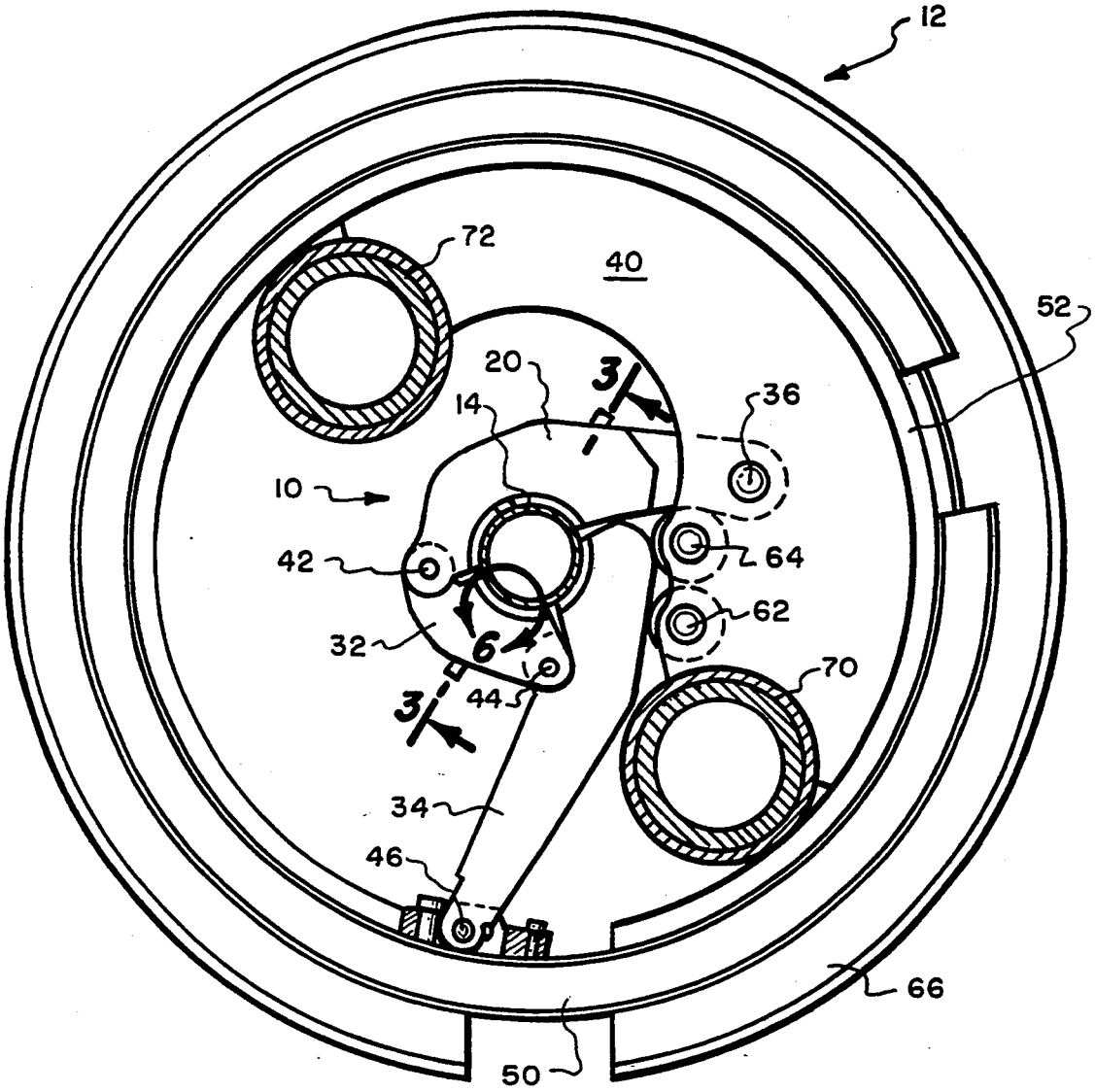
FIG. 2 is a plan view of a gripping assenbly as shown in FIG. 1 but with the jaws gripping the pipe to transfer torque to the pipe.

FIG. 1 illustrates the jaws 10 of a gripper assembly 12 in an ungripped relationship with the drill pipe 14 and FIG. 2 illustrates the jaws of the gripper assembly 12 in a gripped relationship with the drill pipe 14.

Gripper assembly 12 with its jaws 10 is shown herein only to illustrate this invention. This gripper assembly is essentially a power pipe tong and the jaws of any manual or power pipe tong could have been shown equally as well since this invention is directed to an improvement in the grippers located on the laws to apply torque to the pipe 14. Reference is made to the U.S. patent application Ser. No. 07/871,949, filed Apr. 22, 1992, entitled Floor Drive Drilling System, now U.S. Pat. No. 5,265,683, if more information is required. However, the gripper assembly 12 will be described herein in sufficient detail to show how the jaws grip the drill pipe.

In these figures, the jaws 10 comprise an anchored arm 20, four grippers 22,24,26 and 30, a connecting link 32 and a leading arm 34. Two grippers 22 and 24 are located on the anchored arm 20, one gripper 26 is located on a connecting link 32 and the other gripper 30 is located on the leading arm 34.

The anchored arm 20 is pivotally connected at one end by an anchor pin 36 fixed between two plates 40 (one shown) and is pivotally connected at its other end at 42 to the cvonnecting link 32. The other end of the connecting link 32 is pivotally connected at 44 to the leading arm 34 between its gripper and the other end of the leading arm 34. The other end of the leading arm 34 is pivotally connected at 46 to a gripper ring 50.

As shown in these figures, rotation of an inner gripper body ring 52 (of which plates 40 are a part) and retardation of the rotating gripper ring 50 by a gripping braking system represented by circles 60 in FIG. 1 causes the four grippers 22–30 to grip and rotate the pipe 14 with the leading arm 34 in camming relationship with two body rollers 62 and 64. Another rotating ring 66, an ungripping ring, and an ungripping brake system represented by circles 68 causes the laws to ungrip the pipe. Actually, torque is transferred to the jaws by guide posts 70 and 72 to the gripper body ring 52 and to the anchor pin 36 where the latter pulls the anchored arm 20 creating the effect of hinged jaws of a pipe tong. Guide posts 70 and 72 are rotated by the master bushing located at the rig floor. While the above discussion relates to the system of Ser. No. 07/871,949 above noted, and incorporated herein by reference, the improved gripper jaws of the invention may be used with any conventional power pipe tong, as that of the Slater U.S. Pat. No. 4,869,137, also above noted, wherein the jaw-carrying ring A is braked while ring gear R pivots pipe gripping jaws J into clamping contact with a pipe to be subjected to rotational torque. Many other patents show generally similar arrangements of braking and pivoting gripper jaws.

Figure 3:
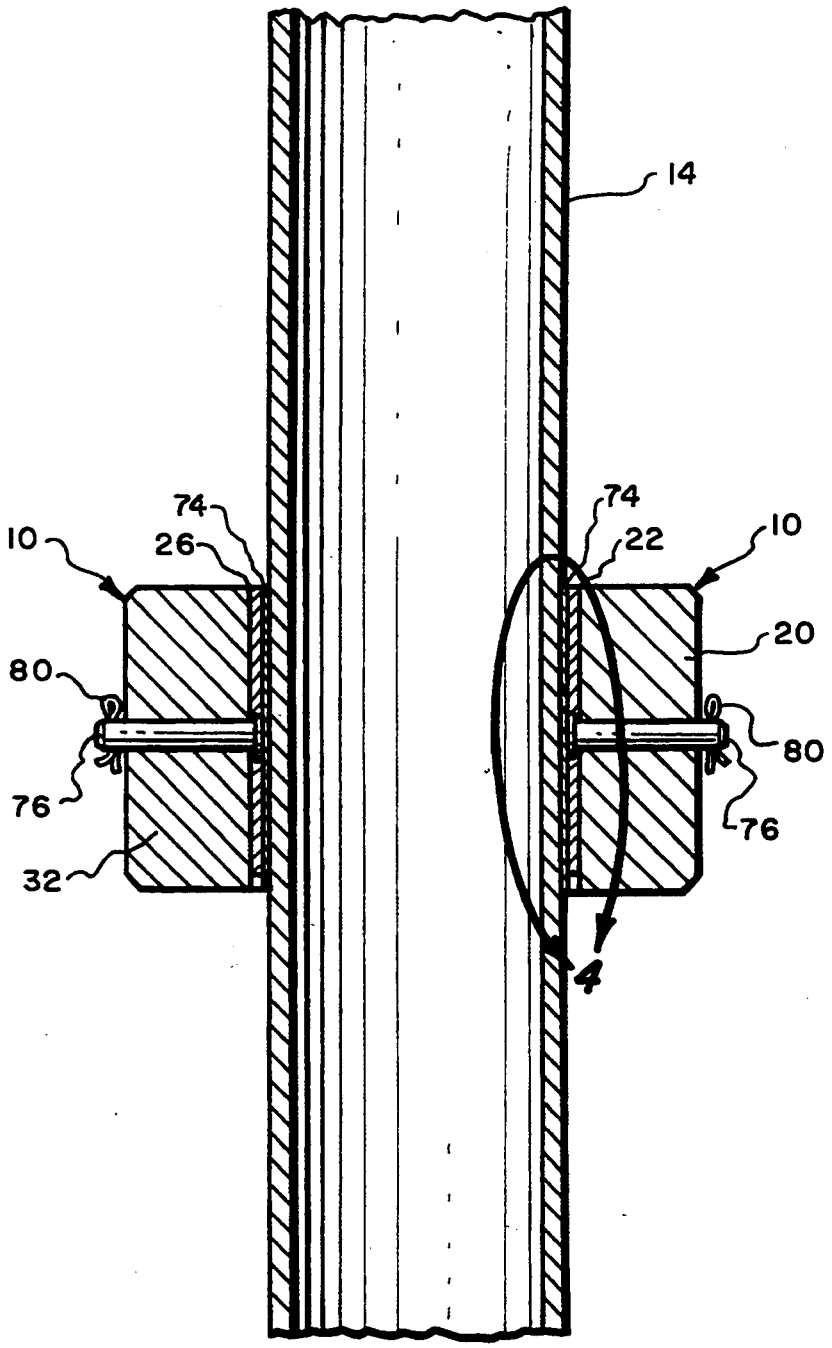
FIG. 3 is an elevational cross-sectional view taken along line 3—3 of FIG. 2.
Figure 4:
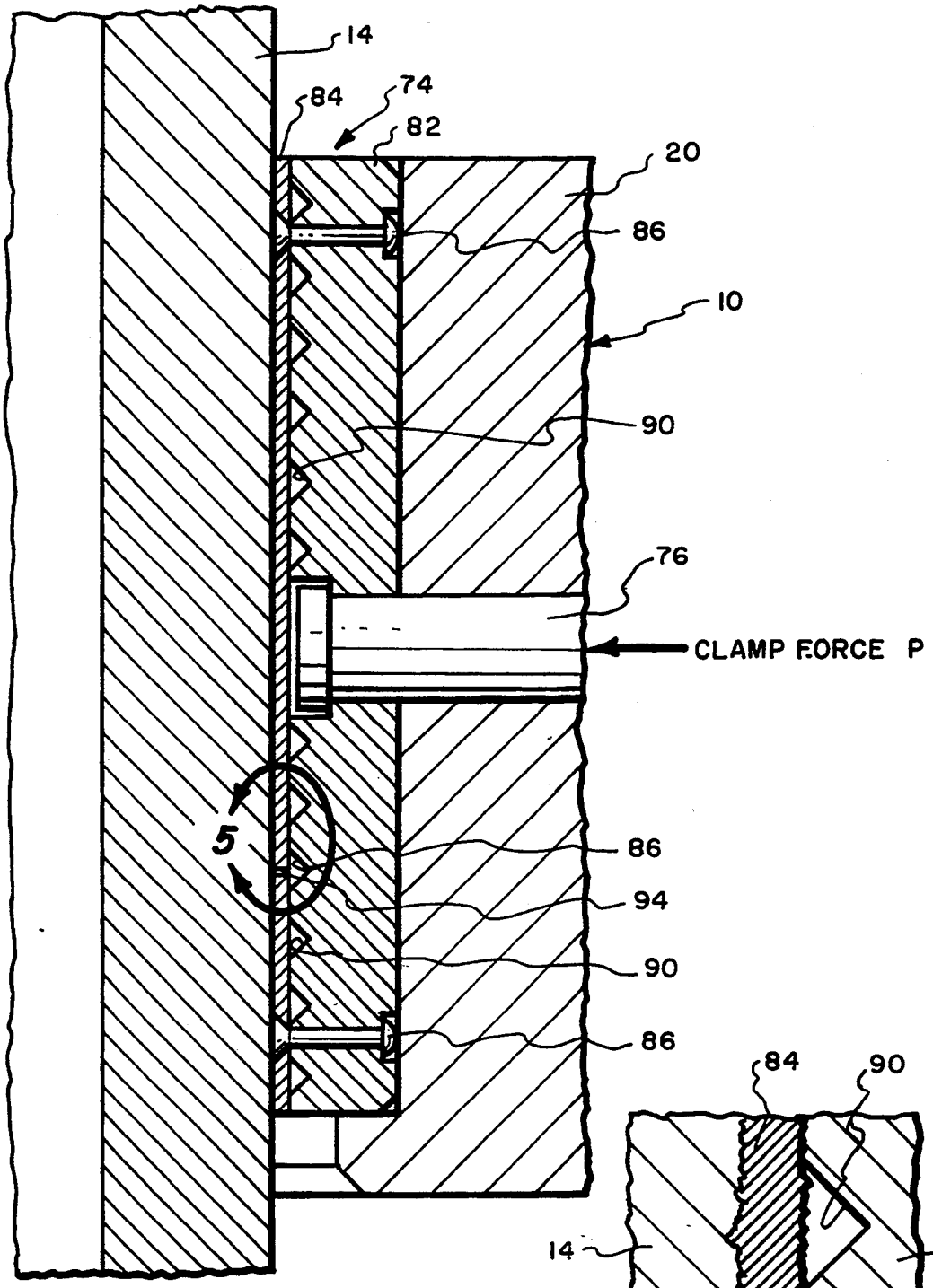
FIG. 4 is an elevational view enlarged in the area encircled at 4 in FIG. 3.
Figure 5:
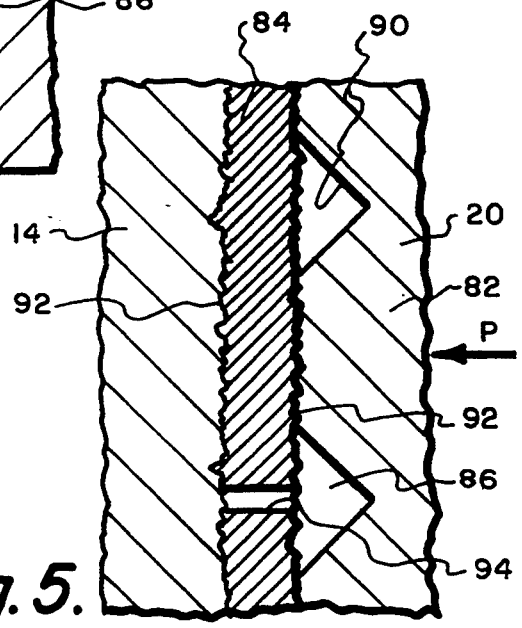
FIG. 5 is an enlargement of the area encircled at 5 in FIG. 4.

Turning now to FIGS. 3,4 and 5, there is shown a pair of grippers 22 and 26 on jaws 10 (actually leading arm 20 and connecting link 32, all of which will hereinafter be referred to as jaws). Grippers 22–30 comprise insert assemblies 74 which are each connected in any suitable way to each jaw as by an insert retaining pin 76 and a cotter pin 80.

As more clearly shown in FIG. 4, each insert assembly 74 includes an insert 82 and an insert face 84 of bonding key or facing material which is relatively thin as compared to the insert 82. The insert facing material may be either a layer or coating of a soft alloy applied by technologies currently available such as hot metal flame spraying or plasma spraying or may be sheeting of a soft alloy. (A listing of suitable alloys is setforth hereinafter). If the coating process is used, the layer will adhere to the surface of the insert 82 and if sheeting is used, the insert face 84 and the insert 82 are connected to one another in any suitable manner as by rivets 86 or by adhesive bonding. The face of the insert 84 nearest the pipe wall has a plurality of horizontal grooves 90 machined or otherwise formed in the face of the insert 82 and are covered by the insert face 84. The integrity of these grooves 90 are maintained during the coating process by suitable steel inserts (not shown) which are removed after the coating process is finished. These grooves increase the contact load on the pipe and may be oriented in either a horizontal or a vertical direction. The insert face is a key between the pipe surface and the insert.

FIG. 5 shows a portion of the pipe 14, insert face 84 and insert 82 all in intimate contact with jagged faces 90 and 92 representing its imperfections in the pipe insert and insert face. This figure clearly shows the bonding by the key bonding material 84 between the pipe and the steel insert. This figure also shows drain holes 94 communicating with the pipe 14 and the horizontal grooves 90 for drainage.

More specifically in the practice of this invention, it can be shown that compressive loading and facing material thickness are important factors.

The amount of flow of facing material into the pipe is proportional to unit compressive loading and the area of contact between the facing material and the pipe.

The facing material in the area of contact must be loaded beyond its ultimate compressive strength and thus be forced to flow into the pipe and fill up any uneveness in the pipe surface. It is also important that the entire facing be loaded beyond its compressive strength so that the facing material has no place to flow or deflect other than its intended direction and the thickness of the facing material is important in this regard. If the facing material were too thick, the material acts as a cushion by redistributing the compressive load within the material itself.

Typical examples of the factors involved in this invention are:

the facing material should be a ductile alloy with a thickness within 0.020" to 0.070" and with a high shear capability. If aluminum alloy is selected, it has a hardness within Brinell 20 to 47 and a shear strength of around 9 to 20 ksi with a resulting coefficient of drag of from 0.5 to greater than 1.0, the modulus of elasticity for the facing material is within the area of 9 million to 16 million psi with a compressive strength in the range of 9 thousand to 20 thousand psi, the insert material should have a high modulus of elasticity of around 30 million psi and a compressive strength of around 50 thousand to 150 thousand psi, and while the compressive loading on the facing material is uneven due to tolerances on the pipe and insert, the compressive loading is in the range of 10 thousand to 60 thousand psi and possibly significantly higher in some spots.

While the facing material may be sheeting of bronze or aluminum, a coating of the insert with a soft alloy to the thickness specified is preferred. Presently such a coating may be performed by flame spraying or plasma spraying or by other technologies currently available.

Tests on alloys as facing material with medium for high carbon steel backing (insert) and bonding with steel drill pipes have been performed. The facing material that have been tested satisfactorily are:

1. Aluminum alloy 3003-H14
2. Aluminum alloy 3003-14
3. Aluminum alloy 3003-H12
4. Aluminum alloy 1100-H14
5. Aluminum alloy 1100-0

6. Aluminum alloy 2024-0
7. Aluminum alloy 5050-0
8. Soft bronze alloys
9. Aluminum silicon mix.

Tests have also been made using soft iron (transformer iron alloy 98% pure) as a facing material is preferably used in combination with tubulars made from hard stainless steel and copper alloys.

Figure 6:
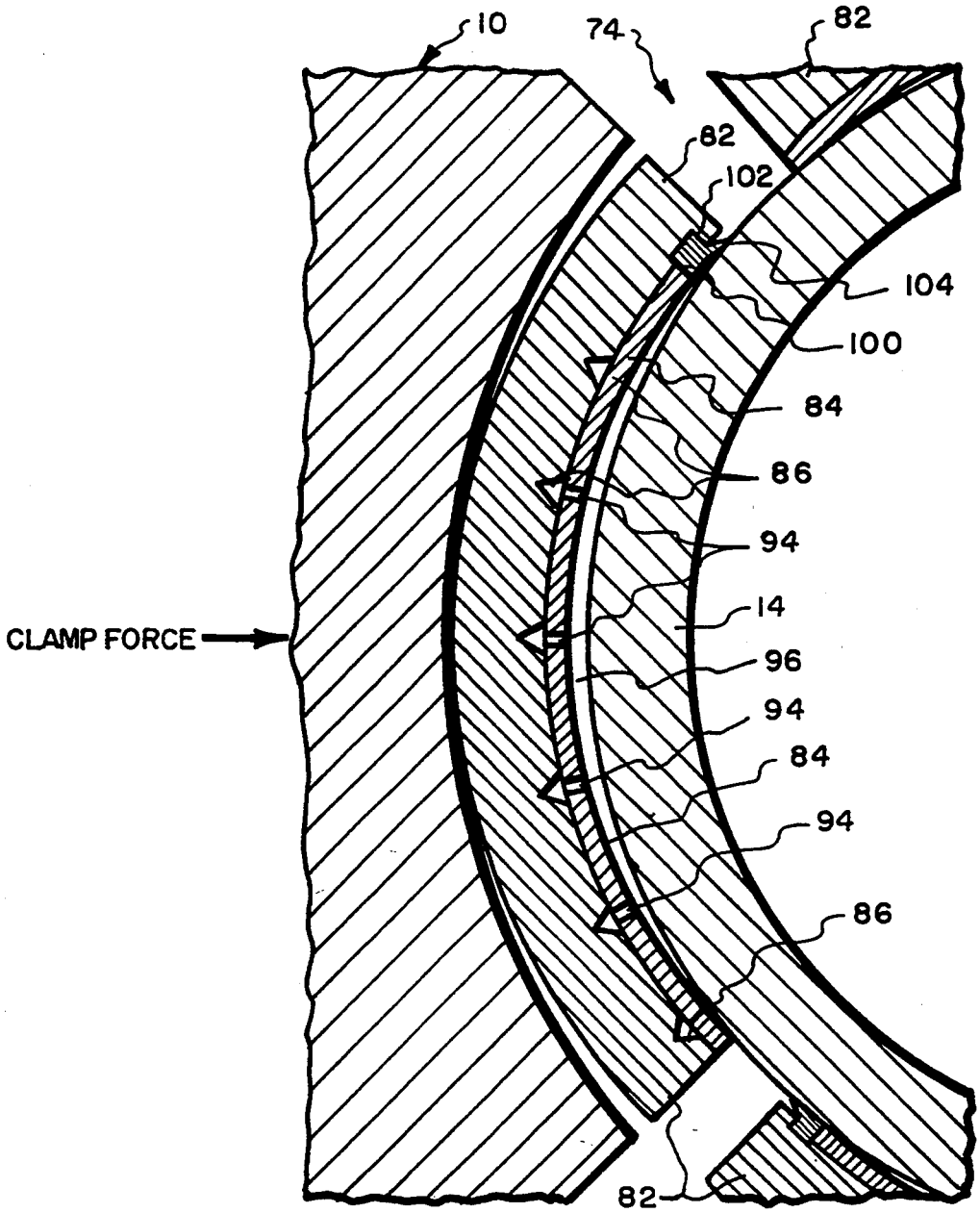
FIG. 6 is a cross-sectional view of the area encircled at 6 in FIG. 2 greatly enlarged for clarity.
Figure 7:
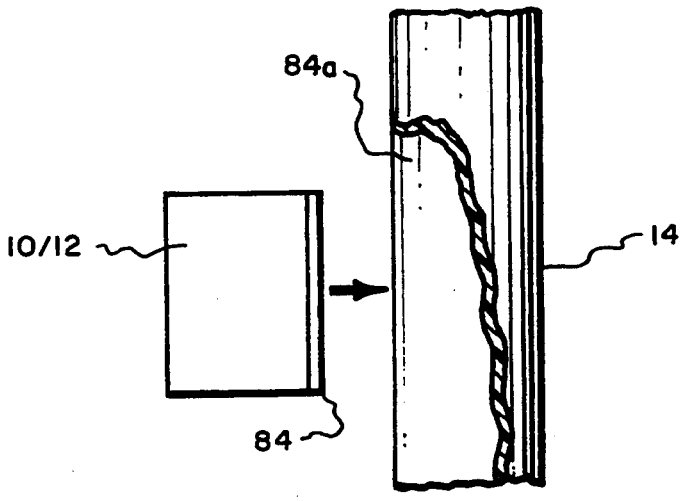
FIG. 7 is an elevational and schematic view of a gripper assembly facing a prepared pipe surface.

FIG. 6 shows the jaw 10 and the insert assembly 74. As shown clearly in this figure, the diameter of the insert assembly is less than the diameter of the pipe 14 to provide a starting gap 96 between the insert face 84 and the pipe 14. To assure later contact with the pipe of varying diameter, the insert 82 is made of spring steel so that radial clamping forces are applied, the insert assembly straightens out and wraps around the pipe. This figure also shows the plurality of holes 94 in the insert face communicating with vertical grooves 86. Located at the leading edge 100 of the insert face 84 and in a vertical groove 102 in the insert is a flexible wiper 104 to prevent contamination and grease from entering between the insert face and the drill pipe.

From the foregoing, it can be seen that easy and quickly replacable insert faces may be discarded with wear and these faces are not dangerous if dropped down hole. Also, this development includes an opportunity to prepare the surface of a pipe for contact with a particularly selected key bonding material such as aluminizing the pipe by spray for aluminum key bonding material. By the preparation of the pipe surface with the same material as the key bonding material, the two materials have been found to bond together more efficiently. It has also been found that a watering of the pipe surface improves the operation of the gripping by removing contamination from the contact area. Finally, repeatable gripping of the same pipe surface improves the strength of the bond.

I claim:

1. In a torque transfer apparatus for transferring torque to a pipe including jaws which are operated to provide a clamping force on a pipe and which are rotated to transfer torque to the pipe to rotate the same, the improvement comprising a gripping assembly on said jaws which includes:

metallic insert means mounted on said jaw and having a gripping surface and, a metallic insert face material therefor so as to be disposed between said insert means and a pipe when said gripping assembly is clamped to the pipe, said face material having a pipe-side surface and a jaw-side surface, said insert face material being a ductile material with a high shear capability and softer than said insert means, and softer than the pipe to which torque is applied by said apparatus, thereby to provide a keyed bond between the pipe and the pipe-side surface of the said metallic insert face material by the flow of the insert face material into imperfections in the surface of the pipe upon application of clamping force to the jaws, which force is maintained during rotation of the jaws for the transfer of torque to the pipe, and whereby the torque capable of being transferred by the jaws to the pipe is a function of the said shear capability of the insert face material, which, if exceeded, will cause relative slippage between the said insert face material and the pipe sought to be rotated, thereby preferentially galling the pipe-side surface of said insert face material, whereby the surface of the pipe sought to be rotated is left undamaged notwithstanding the rotational torque applied to the jaws.

2. The improvement as claimed in claim 1 wherein said face material has a thickness within 0.020" to 0.070".

3. The improvement as claimed in claim 2 wherein said ductile material is an aluminum alloy.

4. The improvement as claimed in claim 2 wherein said ductile material is a soft bronze alloy.

5. The improvement as claimed in claim 2 wherein said ductile material is an aluminum silicon mix.

6. The improvement as claimed in claim 2 wherein said ductile material is a soft iron.

7. A process for preventing galling of the surface of a pipe when subjected to clamping and rotational torque comprising the steps of:

providing a plurality of clamping jaws, providing a gripping assembly on each of said jaws, including a rigid jaw insert adjacent the jaw, and a thin metallic insert face material adjacent the jaw insert, with the insert face material having a predetermined shear strength and being of softer material than either the jaw insert or the pipe to be clamped, clamping a pipe at its periphery between said jaws with sufficient force to deform the face material and drive the same into imperfections in the surface of the pipe to provide a bond between the pipe and the face material, and exerting torque force on the clamped pipe by said jaws, whereby if the applied torque force exceeds the shear strength of the face material between the jaws and the pipe, the bonded softer face material will be preferentially galled by relative rotation between the pipe and the face material, whereby the pipe surface will not be galled by the face material.

8. The process as claimed in claim 7 wherein the thin insert face material selected has a thickness of between 0.020" and 0.070" and is ductile with a shear strength of around 9 to 20 ksi.

9. The method as claimed in claim 7 further including the step of coating said pipe with the same soft material before said bond is provided.

10. In a torque transfer apparatus for transferring torque to a pipe including jaws which are operated to provide a clamping force and which are rotated to transfer torque to the pipe, the improvement comprising a gripping assembly on said jaws which includes metallic insert means and a metallic insert face material therefor which is softer than said insert means, and softer than the pipe to which torque is applied by said apparatus, thereby to provide a bond between the pipe and the said metallic insert face material by the flow of the insert face material into imperfections in the surface of the pipe upon application of the clamping force to the jaws, which force is maintained during rotation of the jaws for the transfer of torque to the pipe, and, said insert means is provided with grooves for engaging said insert face material, and said face material is provided with drainage means which communicate with said grooves.

11. The apparatus as claimed in claim 10 wherein said insert face material is either aluminum or bronze.

12. The apparatus as claimed in claim 11 wherein the torque transferred to the pipe is a function of the shear strength of the insert face material which, if exceeded, will gall the surface of the insert face material leaving the pipe surface undamaged.

13. The apparatus as claimed in claim 12 including means for removably holding said insert face material on said insert means so as to be removable from said insert means after galling or wearing of said insert face material.

14. The apparatus as claimed in claim 13 wherein said insert means and said insert face material are of the less radius of curvature than the pipe so that said insert means and said insert face material will flatten under said clamping force against said pipe to provide a better gripping of the pipe.

15. The apparatus as claimed in claim 14 wherein said insert means comprises spring steel.

16. The apparatus of claim 15 wherein said insert face material is substantially thinner than said insert means.

17. The method of transferring torque to a pipe by a torque transfer apparatus which includes jaws with insert means, the improvement comprising the steps of, interposing a soft metallic face material between the insert means and the pipe, providing said insert means with grooves for engaging said metallic face material, providing said metallic face material with drainage means which communicate with said grooves, bonding said soft face material to the pipe by a clamping force imposed on said pipe by said jaws for the transfer of torque by the shear strength of the soft material, and rotating said jaws for transferring torque to the pipe while maintaining said clamping force.

18. The method as claim in claim 17 further including the step of coating said pipe with the same soft face material before said bonding step.

* * * * *